United States Patent [19]

Rodgers et al.

[11] Patent Number: 4,692,089

[45] **Date of Patent: * Sep. 8, 1987**

[54] ATTACHMENT FOR A BACK HOE BUCKET

[76] Inventors: Charles E. Rodgers, 9007 Noroad, Jacksonville, Fla. 32210; Herman R. Rodgers, P.O. Box 43, Ellerslie, Ga. 31807

[ * ] Notice: The portion of the term of this patent subsequent to Dec. 24, 2002 has been disclaimed.

[21] Appl. No.: 801,200

[22] Filed: Nov. 25, 1985

Related U.S. Application Data

[63] Continuation-in-part of Ser. No. 587,054, Mar. 7, 1984, Pat. No. 4,560,318.

[51] Int. Cl.[4] ..... B66F 9/12

[52] U.S. Cl. ..... 414/724; 37/DIG. 3; 37/DIG. 12; 172/253

[58] Field of Search ..... 414/724, 912; 37/DIG. 3, DIG. 12; 172/245, 250, 253, 254

[56] References Cited

U.S. PATENT DOCUMENTS

| | | | |
|---|---|---|---|
| 3,312,361 | 4/1967 | Foster | 414/724 |
| 4,175,900 | 11/1979 | Etzler | 414/724 X |
| 4,560,318 | 12/1985 | Rodgers | 414/724 |

*Primary Examiner*—Joseph E. Valenza
*Assistant Examiner*—Donald W. Underwood
*Attorney, Agent, or Firm*—Arthur G. Yeager

[57] ABSTRACT

The attachment includes a pair of spaced support arms secured to the sides of a bucket of a back hoe vehicle and receive an elongated upper rectangular bar, and a pair of adjustably spaced fork arms attached to the upper bar. An elongated lower bar extends substantially parallel to the upper bar and is adjustably supported by the fork arms and engages against the back wall of the bucket. The lower bar may be adjustably elevated on the fork arms and provides rigidifying support for the fork arms in their outwardly extended position.

22 Claims, 9 Drawing Figures

ATTACHMENT FOR A BACK HOE BUCKET

CROSS-REFERENCE TO RELATED PATENT

This application is a continuation-in-part of U.S. application Ser. No. 587,054, filed Mar. 7, 1984, and now U.S. Pat. No. 4,560,318 granted Dec. 24, 1985.

BACKGROUND OF THE INVENTION

This invention relates to attachments for back hoe buckets of vehicles, and more particularly, to an attachment including a fork lifting device.

There have been many attachments to buckets of vehicles, both front and back types of buckets, as shown by the following U.S. Pat. Nos.:

| | | | |
|---|---|---|---|
| 2,421,472 | Way | 3,921,837 | Vandewater |
| 2,488,695 | Upton | 4,056,205 | Etzler |
| 2,577,977 | Nelson | 4,120,405 | Jones et al |
| 3,312,361 | Foster | 4,125,952 | Jennings |
| 3,421,642 | Carter | 4,172,687 | Schultz |
| 3,440,744 | Smith | 4,175,900 | Etzler |
| 3,665,622 | Lamb | 4,200,423 | Sornsin |
| 3,667,633 | Cappella | 4,242,035 | Hornstein |
| 3,706,388 | Westendorf | 4,247,243 | Carter |
| 3,749,262 | Stark | 4,275,985 | Schremmer |
| 3,807,802 | Betters | 4,329,103 | Miller |
| 3,812,979 | Leihgeber | 4,360,980 | Jarvis |

and by British Pat. No. 1,373,646.

The prior art attachments are often complex in design, expensive to manufacture and not readily installed and/or maintained. Often the entire attachment must be removed from the bucket to enable use of the bucket in the intended manner. These and other problems are believed to be substantially alleviated by the attachment according to the hereinafter disclosed invention.

SUMMARY OF THE INVENTION

The attachment for a back hoe bucket according to this invention includes a pair of elongated spaced support arms secured to and extending above respective side walls of the back hoe bucket adjacent the rear wall thereof, and each arm has an opening therethrough adjacent its upper end in substantial alignment with each other laterally of the bucket with each bottom wall forming the opening being generally flush with an upper edge of respective side wall of the bucket. An elongated upper bar extends laterally outwardly through the aligned openings in the arms and supported by the arms and adapted to be supported by the upper edge of the side walls of the bucket. A pair of elongated generally upright members each include lower and upper ends supported by the upper bar outboard of respective arms. Selective means releasably attach each of the upper ends of the upright members in selected lateral positions on the upper bar. An elongated lower bar extends substantially parallel to the upper bar, and means are provided to attach the lower bar to each of the upright members spacedly above the lower ends and generally below a back hoe bucket attachment to a boom of a back hoe vehicle to dispose the lower bar supportingly against a back wall of the bucket spaced adjacently above its bottom wall.

In other aspects the attachment in accord with this invention is provided with a pair of fork lift prongs respectively attached to the lower ends of the upright members and extend generally horizontally of the upright members. The means to attach the lower bar to each of the upright members may include a pair of support means carrying the lower bar and adjustable clamp means connected between respective support means and the upright member to selectively adjust the position of each of the support means along respective upright members. The upright members may have elongated slots with the clamp means including a pair of threaded bolts passing through respective support means and the lower bar and the upright member through the elongated slot and a pair of nut fasteners threadedly engaged on the bolts to releasably affix the lower bar in selected positions along the slots. The means to attach the lower bar to each of the upright members includes a clamp means slideable on each of the upright members, means to releasably affix the clamp means to the upright members, and support means carried by the clamp means for supporting the lower bar. The clamp means includes a hollow box element and the means to releasably affix the clamp means includes a set screw threadedly engaged with one wall of the box element with an inner end of the set screw selectively engaging the upright member passing through the hollow box element. Each support means carried by the clamp means may include at least one plate extending laterally of each box element between the upright member and the back wall of the bucket, and the one plate has an opening through which the lower bar extends. Each support means may also include another substantially identical plate extending laterally of each box element and parallel to the one plate.

In yet other aspects, the attachment according to this invention is seen to include releasable means for securing each of the spaced support arms to respective side walls of the bucket, the releasable means including a first bolt and nut fastener passing through and fastened about a first opening in each support arm below the opening receiving the upper bar in the upper end of the arm, and an aligned opening in the bucket, and a second bolt and nut fastener passing through and fastened about an arcuate slotted second opening in each support arm below the first opening and another aligned opening in the bucket generally located centrally of the second opening to permit angular adjustment of the support arms about the first bolt and nut fastener.

Further aspects in accord with this invention are directed to the provision of the selective means to releasably affix each upright upper end to the upper bar includes a set screw threadedly engaged with the upright upper end and engaging the upper bar. In an alternate embodiment each selective means includes a bolt and nut fastener passing through and secured to respective upright member and the upper bar. Each upright member includes a hollow box element forming each upper end thereof with the upper bar passing through the hollow of respective box element, the nut and head of the bolt engaging on opposite side walls of the box element with the bolt passing through the opposite side walls and the upper bar.

Additional aspects are provided to the attachment according to this invention wherein each upright member includes a hollow box element forming each upper end thereof with the upper bar passing through the hollow of respective box element. Each selective means is engaged on the box element and engages the upper bar. The selective means includes a set screw threadedly engaged with one wall of the box element and engaging the upper bar internally of the box element.

The upper bar may be hollow and may conform in shape to the hollow box element with such shapes being complementary and are substantially square. Therefore the lower bar may be substantially square and each of the means to attach the lower bar to each of the upright members includes a pair of support means having a substantially square opening receiving the square lower bar. The lower bar may be substantially round and each of the means to attach the lower bar to each of the upright members includes a pair of support means having a substantially round opening receiving the round lower bar.

The principal object of this invention is to provide an attachment to a back hoe bucket to be employed to load and unload pipe from trucks without detaching the bucket.

Another object of this invention is to provide an attachment which is adaptable to also string pipe, and does not use chains, which are dangerous when applied to P.V.C. pipes to inhibit slippage.

Another object of this invention is to provide an attachable fork lifting device, which will be of such design, as to require only one man to perform the task of loading and unloading pipe.

A further object of this invention is to provide a fork lifting attachment, which will be removably supported on the bucket portion of the back hoe vehicle.

A still further object of this invention is to provide a fork lifting attachment which will be easily adjustable to handle various lengths of pipe, as long as twenty feet, safely.

Other objects of the invention are to provide a fork lifting attachment which will be simple in design, inexpensive to manufacture, rugged in construction, and easy to install and maintain.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DETAILED DESCRIPTION OF THE PREFERRED EMBODIMENTS

Figure 1:
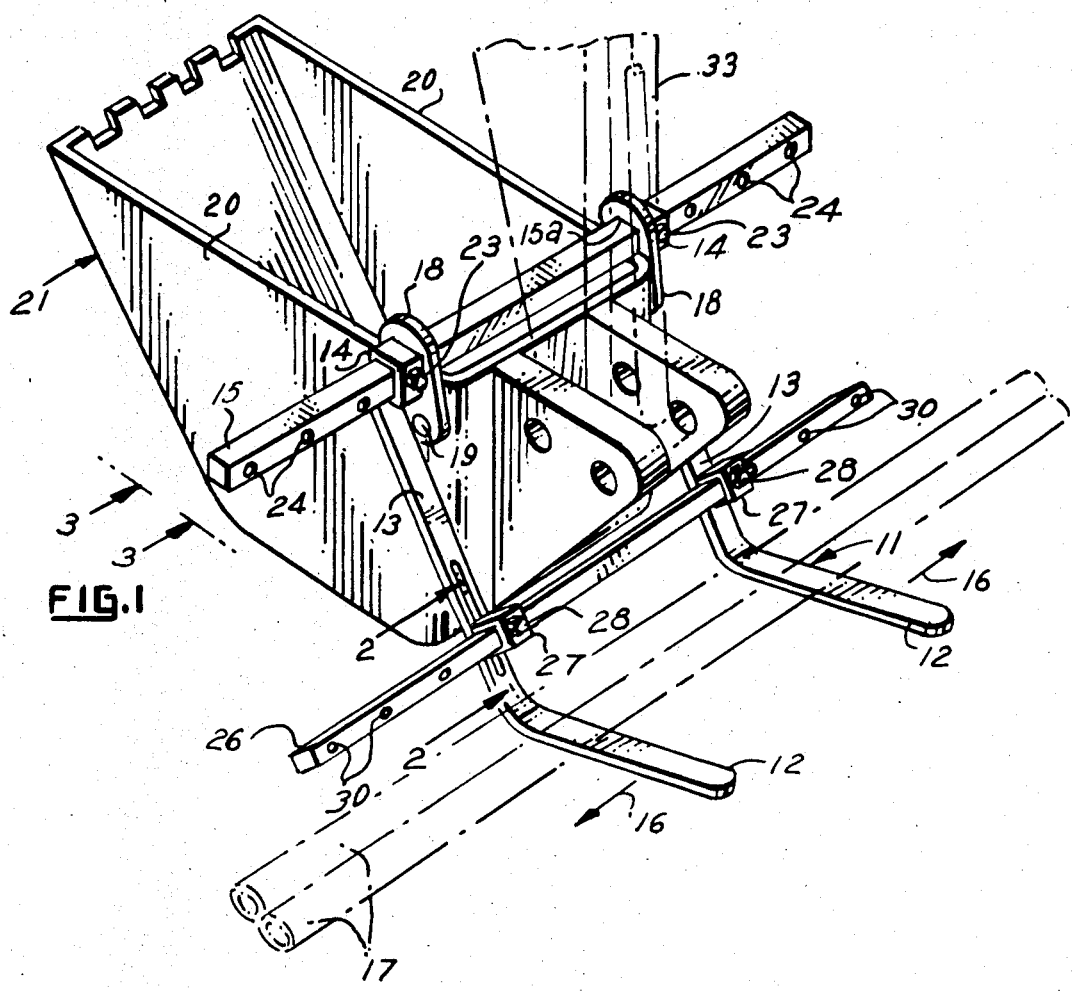
FIG. 1 is a perspective view of the attachment in accord with the first embodiment of the present invention, shown installed on the bucket of a back hoe vehicle, and illustrating pipes thereon, in phantom.
Figure 2:
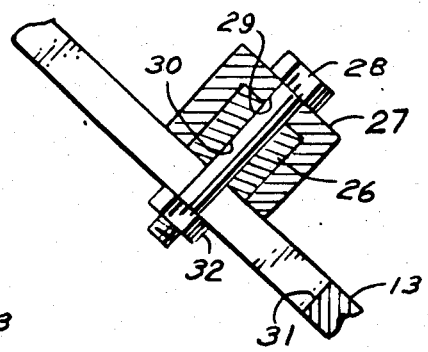
FIG. 2 is an enlarged cross-sectional view, taken along line 2—2 of FIG. 1.
Figure 3:
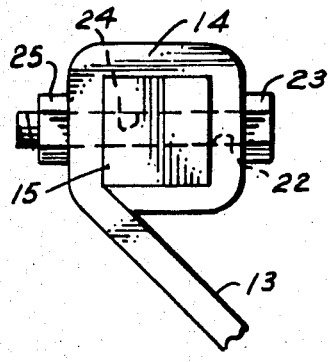
FIG. 3 is an enlarged view, taken along line 3—3 of FIG. 1.
Figure 4:
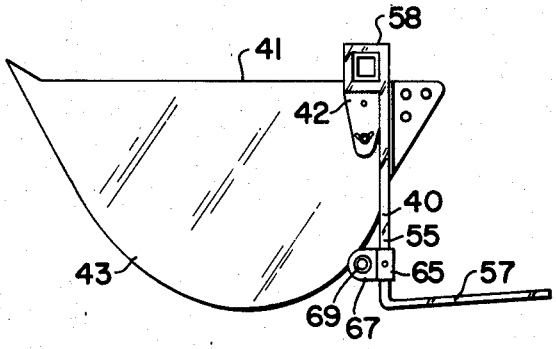
FIG. 4 is a side elevational view of the attachment in accord with the second embodiment of the present invention.

According to the first embodiment of the invention the attachment 11 is generally depicted as a fork lifting device and includes a pair of flat prongs 12, that are common in the art for loading and unloading types of vehicles. The prongs 12 are angularly formed at their upper portions 13 and terminate by means of a box like eye 14, formed integrally therewith, and which freely and slideably receives an upper elongated steel member or bar 15, which in this instance, is of square cross-sectional configuration, which is preferably about nine feet in length for horizontal adjustment of spread between the prongs 12 of fork attachment 11, as indicated by means of the arrows 16. Bar 15 is also slideably received within the openings 15*a* of spaced mounting arms 18 which extend above the upper edges of side walls 20 of bucket 21. The prongs 12 in this instance, provide a means of supporting pipe 17 in an angularly rearward and cradled manner, to be loaded from one vehicle to another. However, the function of attachment 10 is not limited to lifting and moving pipe, as it may be employed to lift and move other material, such as lumber, etc.

The lower ends of arms 18 are fixedly secured by bolt fasteners 19, to the rear portions of the side walls 20 of bucket 21 of a back hoe vehicle (which is not shown) including the support arm illustrated by broken lines 33 in FIG. 1. Each eye 14 includes openings 22 therethrough, which freely receives a bolt fastener 23, and bolt fasteners 23 are also freely received through a selected one of a plurality of spaced transverse openings 24, bored through bar 15. The fork attachment 11 has its prongs 12 spread apart from each other, to any desired distance, by the bolt fasteners 23 being received in any of the aligned openings 24 chosen, and nut fasteners 25 are threaded onto bolt fasteners 23, so as to render the adjustment secure.

A second lower elongated bar 26 is provided and disposed adjustably below upper bar 15 on prongs 12, for increased rigidity and stability of fork attachment 11 in picking up and supporting pipe 17 on the fork attachment 11 and onto several portions of the bucket. Bar 26 includes a pair of channel clamps 27, of "V"-shaped configuration, in which bar 26 is received slideably for the same general type of adjustment, above described with respect to bar 15. A bolt fastener 28 is freely received in an opening 29 of each channel clamp 27, and is freely received within any one of the desired transverse openings 30 through lower bar 26. Bolt fasteners 28 are freely and adjustably received within respective elongated cut-out openings or slots 31 through the upper portions 13 of prongs 12 of fork attachment 11. Bolt fasteners 28 render bar 26 secured at any desired elevation on prongs 12, by nut fasteners 32 spanning the slots 31 and being tightened against upper portions 13. It should be noted, that the upper bar 15 is disposed on top of the bucket 21 and preferably rests thereon, and is spaced from the support arm 33 of the back hoe vehicle, so as to prevent any interference therewith, when the vehicle and the fork lift attachment are in operation.

In use, the back hoe vehicle is operated in the usual manner, with the exception, that the operator backs the bucket 21 in such a manner, as to cause the forward end of the prongs 12 to guide beneath pipe 17. The operator then pivots the bucket 21 in the usual manner to cause the pipe 17 to lay in the arcuate portions between upper portions 13 and the prongs 12. The operator then lifts the fork attachment 11 and pivots the bucket 21 and fork attachment 11 combination away from the point of pick-up. The fork attachment 11 is then positioned at the unloading site or a vehicle that is to receive the pipe 17. After the above-mentioned, the operator then pivots the bucket 21 and fork attachment 11 combination, while lowering same, to discharge the pipe 17 smoothly therefrom.

Figure 5:
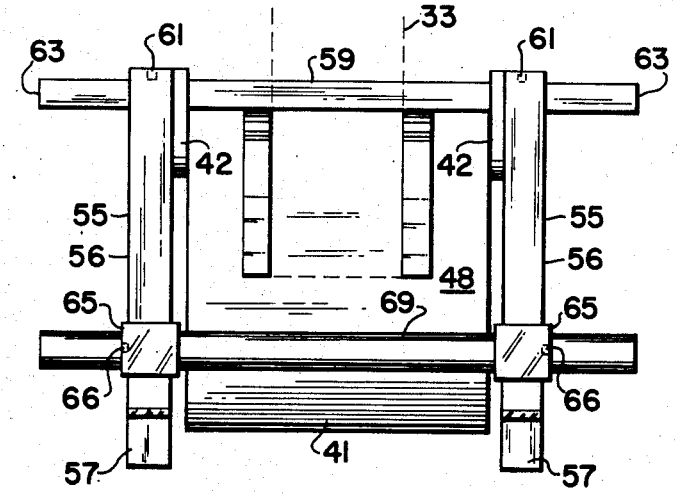
FIG. 5 is a slightly enlarged front elevational view of the attachment of FIG. 4.
Figure 8:
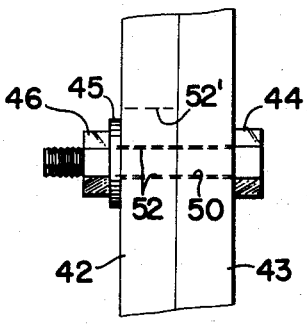
FIG. 8 is an enlarged detail of the connection through the slot in the plate shown in FIGS. 6 and 7.
Figure 6:
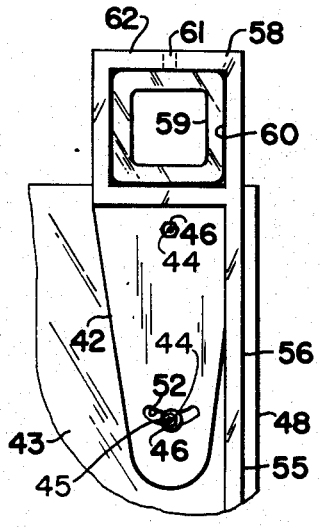
FIG. 6 is an enlarged side elevational view of the upper portion of the attachment of FIG. 4.
Figure 7:
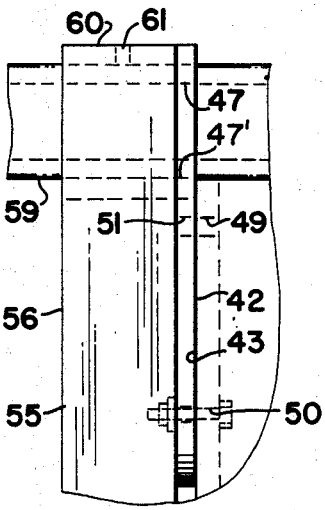
FIG. 7 is a front elevational view of the upper portion of FIG. 6.
Figure 9:
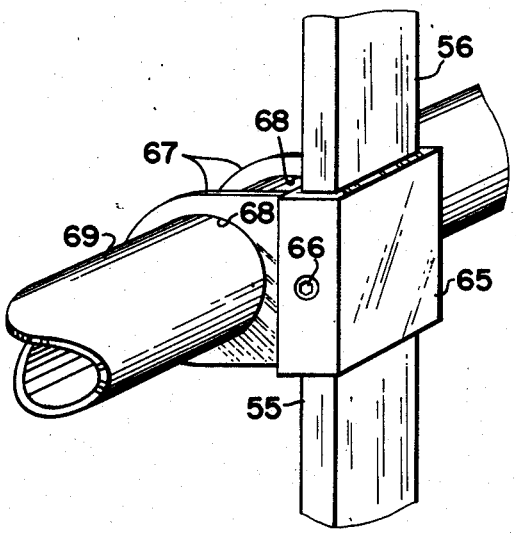
FIG. 9 is an enlarged perspective view of a portion of the spanning lower bar between the forks shown in FIGS. 4 and 5.

A preferred embodiment is illustrated in FIGS. 4–9 in which the attachment 40 for bucket 41 comprises a pair of up-standing arms 42 connected to the side walls 43 of bucket 41 by appropriate bolt, washer and nut fasteners, illustrated in FIG. 8 by bolt 44, washer 45 which may be a lock washer) and nut 46. When attaching arms 42, the flat bottom 47' of square opening 47 through plate 42 is aligned with the top of the bucket 41 closely adjacent the back wall 48 of the bucket 41 and the upper opening 49 is drilled along with another hole 50 spaced downwardly therefrom. Plate 42 includes a hole 51 aligned with hole 49, through which a bolt, washer and nut fasten plate 42 to side wall 43, and an arcuate slot 52 which adjustably aligns with opening 50 to dispose plate 42 in proper angular relation to align opening 47 above side wall and to dispose the remainder of the fork attachment 40 with respect to the rear wall 48 of the bucket 41. As seen in FIGS. 6 and 8, the slot 52 receives bolt 44 at the lowest valley of the slot while the upper extent of the slot is illustrated by broken line 52' in FIG. 8.

The fork attachment 40 includes a pair of spaced fork arms 55 having upper generally upright portions 56 and generally lateral portions or prongs 57. The upper portions 56 terminate in an eye, in the form of a box element 58 which are positioned on elongated upper box member 59, box member 59 being freely received in opening 60 of each box element 58 and through openings 47 in plates 42. The lateral position of the box element 58 on box member 58 is adjustably secured thereto by an Allen or the like set screw 61 threaded into a wall of element 58, herein shown as top wall 62. As shown in FIG. 5, the fork arms 55 are shown in the minimum distance apart and may be adjusted outwardly to adjacent the free ends 63 of box member 59. It is to be noted that box member 59 also is shown resting on and supported by the top of the bucket as seen in FIG. 5.

The upright portions 56 adjacently above the prongs 57 respectively carry box elements 65 freely slideable on portions 56 and adjustably secured in selected positions by Allen or the like type set screws 66. A pair of spaced plates 67 are rigidly affixed to and extend rearwardly away from the prongs 57. Openings 68 are provided in each plate 67 of both box elements 65 and freely receive an elongated lower member 69, member 69 being appropriately engaged against bucket rear wall 48 to provide support therefor during load shifting when bucket 41 is pivoted to dispose the pipe in the arcuate portion between prongs 57 and upper portions 56, as hereinabove described. The lower member 69 is preferably a round pipe but a rectangular member similar to box member 59 may be employed, if desired. While not necessary, a releasable means may be employed between the member 69 and the plates 67 (or element 65) to prevent any inadvertent dislodgement of member 69 laterally from openings 68. A common push pin or cotter pin may pass through openings adjacent the free ends of member 69 or a hose clamp or the like may be employed about member 69 adjacent and outboard of either plate 68 attached to either box element 65.

It will be appreciated that while this embodiment is also shown as a fork lift attachment, other attachments may be configured employing the same basic construction shown herein, except, for example, the prongs would be eliminated and a scraper blade may be attached to the upright portions 56 and thus the scraper blade can be used to move and/or level dirt or the like without detachment of the back hoe bucket. Other similar earth working attachments can similarly be configured on the same basic construction described herein without departing from this invention.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. In an attachment for a back hoe bucket comprising a pair of elongated spaced support arms secured to and extending above respective side walls of a back hoe bucket adjacent a rear wall thereof, each of said arms having an opening therethrough adjacent its upper end in substantial alignment laterally of a back hoe bucket with each bottom wall forming said opening being generally flush with an upper edge of respective side wall of a back hoe bucket, an elongated upper bar extending laterally outwardly through said aligned openings in said arms and supported by said arms and adapted to be supported by an upper edge of respective side wall of a back hoe bucket, a pair of elongated generally upright members having lower ends and upper ends supported by said upper bar outboard of respective said arms, selective means releasably attaching said upper ends of said upright members in selected lateral positions on said upper bar, an elongated lower bar extending substantially parallel to said upper bar, and means to attach said lower bar to each of said upright members spacedly above said lower ends and generally below a back hoe bucket attachment to a boom of a back hoe vehicle to dispose said lower bar supportingly against a back wall of a back hoe bucket spaced adjacently above its bottom wall.

2. In the attachment as defined in claim 1 further comprising a pair of fork lift prongs respectively attached to said lower ends of said upright members and extending generally horizontally of said upright members.

3. In the attachment as defined in claim 1 wherein said means to attach said lower bar to each of said upright members includes a pair of support means carrying said lower bar and adjustable clamp means connected between respective said support means and said upright member to selectively adjust the position of each of said support means along respective said upright members.

4. In the attachment as defined in claim 3 wherein said upright members include elongated slots, said clamp means including a pair of threaded bolts passing through respective said support means and said lower bar and said upright member through said slot and a pair of nut fasteners threadedly engaged on said bolts to releasably affix said lower bar in selected positions along said slots.

5. In the attachment as defined in claim 3 wherein said means to attach said lower bar to each of said upright members includes a clamp means slidable on each of said upright members, means to releasably affix said clamp means to said upright members, and support means carried by said clamp means for supporting said lower bar.

6. In the attachment as defined in claim 5 wherein said clamp means includes a hollow box element and said means to releasably affix said clamp means includes a set screw threadedly engaged with one wall of said box element with an inner end of said set screw selectively engaging said upright member passing through said hollow box element.

7. In the attachment as defined in claim 6 wherein each said support means carried by said clamp means includes at least one plate extending laterally of each said box element between said upright member and a back wall of a back hoe bucket, said one plate having an opening through which said lower bar extends.

8. In the attachment as defined in claim 7 wherein each said support means includes another plate extending laterally of each said box element and parallel to said one plate.

9. In the attachment of claim 1 further comprising releasable means for securing each said spaced support arms to respective side walls of a back hoe bucket, said releasable means including a first bolt and nut fastener passing through and fastened about a first opening in each said support arm below said opening receiving said upper bar in said upper end of said arm, and an aligned opening in a bucket, a second bolt and nut fastener passing through and fastened about an arcuate slotted second opening in each said support arm below said first opening and another aligned opening in a bucket generally located centrally of said second opening to permit angular adjustment of said support arms about said first bolt and nut fastener.

10. In the attachment as defined in claim 1 wherein each said selective means to releasably affix each said upright upper end to said upper bar includes a set screw threadedly engaged with said upright upper end and engaging said upper bar.

11. In the attachment as defined in claim 1 wherein each said selective means includes a bolt and nut fastener passing through and secured to respective said upright member and said upper bar.

12. In the attachment as defined in claim 11 wherein each said upright member includes a hollow box element forming each said upper end thereof with said upper bar passing through the hollow of respective said box element, said nut and head of said bolt engaging on opposite side walls of said box element with the bolt passing through said opposite side walls and said upper bar.

13. In the attachment as defined in claim 1 wherein each said upright member includes a hollow box element forming each said upper end thereof with said upper bar passing through the hollow of respective said box element.

14. In the attachment as defined in claim 13 wherein each of said selective means is engaged on said box element and engages said upper bar.

15. In the attachment as defined in claim 14 wherein each said selective means includes a set screw threadedly engaged with one wall of said box element and engaging said upper bar internally of said box element.

16. In the attachment as defined in claim 15 wherein said upper bar is hollow.

17. In the attachment as defined in claim 16 wherein said upper bar and said hollow box element have complementary shapes.

18. In the attachment as defined in claim 17 wherein said complementary shapes are substantially square.

19. In the attachment as defined in claim 1 wherein said lower bar is substantially square and each of said means to attach said lower bar to each of said upright members includes a pair of support means having a substantially square opening receiving said square lower bar.

20. In the attachment as defined in claim 1 wherein said lower bar is substantially round and each of said means to attach said lower bar to each of said upright members includes a pair of support means having a substantially round opening receiving said round lower bar.

21. An attactment for a back hoe bucket comprising a pair of mounting arms for securing said attachment to a back hoe bucket, a pair of fork arms respectively supported by said pair of mounting arms, an elongated upper bar received on said pair of fork arms and on said pair of mounting arms, a pair of clamp means freely received on said upper bar, and an opening through each said pair of clamp means, a pair of bolt fasteners respectively secured to and passing through said openings in said pair of clamp means and respective equally spaced transverse openings through said bar for adjustment spread of said pair of fork arms from each other, an elongated lower bar, and another pair of bolt fasteners secured to and respectively passing through an elongated cut-out opening slot through each said fork arm to provide adjustment in elevating and lowering said lower bar on said fork arms, each said other bolt fastener releasably locking said lower bar at any desired elevation on said pair of fork arms.

22. An attachment for a back hoe bucket comprising a pair of mounting arms for securing said attachment to a back hoe bucket, a pair of elongated fork arms having upper ends respectively supported by said pair of mounting arms, an elongated upper bar received on said pair of fork arms and on said pair of mounting arms, each said fork arms upper ends including a hollow box element to receive said upper bar, releasable means engaged on said box element to selectively clamp said box element to said upper bar for adjustment spread of said pair of fork arms from each other, an elongated lower bar extending substantially parallel to said upper bar, a pair of hollow box elements respectively receiving a generally upright portion of and medially of each said fork arm, said hollow box elements carrying said lower bar, and releasable means engaged on each said box element to selectively clamp said box element to each said generally upright portion to provide adjustment in elevating and lowering said lower bar on said fork arms.

* * * * *